US006517369B1

(12) United States Patent
Butterbaugh et al.

(10) Patent No.: US 6,517,369 B1
(45) Date of Patent: Feb. 11, 2003

(54) RETENTION BRACKET/COLLAR FOR CIRCUIT CARDS

(75) Inventors: Matthew Allen Butterbaugh, Rochester, MN (US); Donald Wayne Dingfelder, Winona, MN (US); Yasuharu Yamada, Shiga-ken (JP)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 10/098,791

(22) Filed: Mar. 14, 2002

(51) Int. Cl.[7] ..... H01R 13/62
(52) U.S. Cl. ..... 439/327
(58) Field of Search ..... 439/327, 325; 361/801

(56) References Cited

U.S. PATENT DOCUMENTS 5,462,440 A * 10/1995 Rothenberger ..... 439/66
5,943,218 A * 8/1999 Liu ..... 361/683
6,007,357 A * 12/1999 Perino et al. ..... 439/327
6,236,573 B1 * 5/2001 Gundlach et al. ..... 312/332.1
6,319,037 B1 * 11/2001 Lai ..... 361/801
6,370,036 B1 * 4/2002 Boe ..... 24/563

* cited by examiner

*Primary Examiner*—Lynn D. Feild
*Assistant Examiner*—Phuong Dinh
(74) *Attorney, Agent, or Firm*—Karuna Ojanen

(57) ABSTRACT

A bracket/collar is disclosed to circumscribe an integrated circuit card into an electrical or an optical connector. The bracket/collar has several features, such as grooves, to hold the circuit card into the bracket; the grooves may be on any available edge not mating with or held by the connector, and may hold a corner or other feature of the circuit card. Another feature of the bracket/collar is a mechanism, such as a hook or notch, to connect with the connector. Yet another feature of the bracket/collar is that, by its shape, it provides sufficient loading of the circuit card into the connector so that when dropped or otherwise mechanically shocked, the circuit card is not displaced from its connector. The bracket/collar is especially useful to secure DIMM memory cards within their electrical connectors in handheld computers.

8 Claims, 4 Drawing Sheets

RETENTION BRACKET/COLLAR FOR CIRCUIT CARDS

FIELD OF THE INVENTION

The present invention relates generally to the field of mounting circuit cards onto boards, and more particularly relates to a retention bracket/collar for removable circuit cards.

BACKGROUND OF THE INVENTION

Electronic processing devices are becoming smaller and smaller, faster and faster, with lower operating voltages. Thus, while the standard for portable computability used to be the laptop computer, it is now becoming the handheld computer. Handheld computers, because of their portability, are exposed to more environmental changes, including being dropped by the user. One of the consequences of this "shock/drop" is that the memory and other integrated circuit cards often come out of their connectors within the computer. The standard connectors used for memory cards in these handheld computers have spring loaded arms to hold the memory cards on opposite sides and these arms simply do not have enough strength to prevent the memory card from springing out of its connector under shock/drop conditions. This malfunction may not even be immediately noticed. Therefore the computer may be used as intended but the data may not necessarily be stored. There is thus a need in the industry for a retention bracket/collar for integrated circuit cards mounted on boards that are subject to shock/drop.

SUMMARY OF THE INVENTION

These needs and other are met by an embodiment of the present invention, herein disclosed as a retention bracket/collar for a circuit card comprising: a semi-rigid collar having an inner edge shaped to mate with at least one edge of the circuit card; the semi-rigid collar having a hook to connect to a connector; and the shape of the collar to provide a force to the circuit card into the connector. An outer edge of at least one side of the collar opposite the inner edge mating with the circuit card is concave. At least one inner edge of a least one mating side of the collar may have grooves to hold the circuit card, either along an edge of the circuit card and/or the corners of a circuit card. There may be a plurality of grooves alternating on a top and a bottom side of the inside perimeter to hold the edge of the circuit card.

The bracket/collar may be manufactured by thermoplastic injection molding, and as such, may be made from polycarbonate. Alternatively, the bracket/collar may be made from metal.

The invention is further envisioned as a retention bracket/collar for a circuit card comprising: a semi-rigid collar having an inner edge with at least one groove to mate with at least one edge of the circuit card wherein the semi-rigid collar may Page 2 have a hook to connect to a connector into which the circuit card is connected; and the semi-rigid collar may have a concave shape on an outer edge of the collar whose inner edge mates with the circuit card and is opposite the hook to provide a load to the circuit card against the connector.

The invention may also be considered a collar for a circuit card, comprising a means to circumscribe a plurality of sides of the circuit card, the plurality of sides not mating with a connector; a means to retain at least one of the sides of the circuit card not mating with the connector in the collar; a means to apply a spring force to secure the circuit card into the connector; and means to secure the collar to the connector. The retaining means may be at least one groove in a side of the collar opposite the connector and/or the retaining means may further comprise a corner indentation to retain a corner of the circuit card. The applying means may comprise the concavity of at least one of the plurality of sides of the circuit card not mating with a connector. The securing means may be a notched hook on the collar to connect into a hollow in the connector.

The recitation herein of a list of inventive features which are met by various embodiments of the present invention is not meant to imply or suggest that any or all of these features are present as essential or necessary features, either individually or collectively, in the most general embodiment of the present invention or in any of its more specific embodiments.

DESCRIPTION OF THE FIGURES

The subject matter which is regarded as the invention is particularly pointed out and distinctly claimed in the concluding portion of the specification. The invention, however, both as to organization and method of practice, together with further objects and advantages thereof, may best be understood by reference to the following description taken in connection with the accompanying drawings in which:

DETAILED DESCRIPTION OF THE INVENTION

Figure 1:
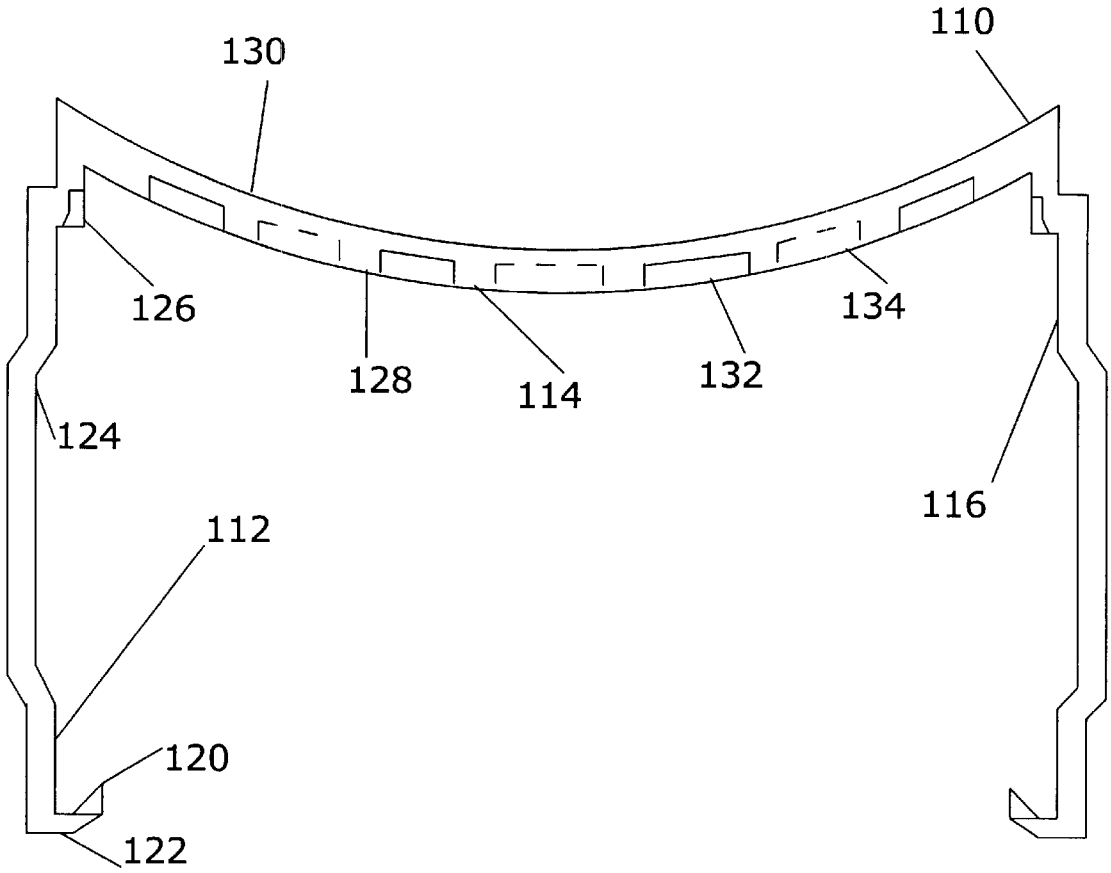
FIG. 1 is a plan view of a retention bracket/collar in accordance with an embodiment of the invention.
Figure 2:
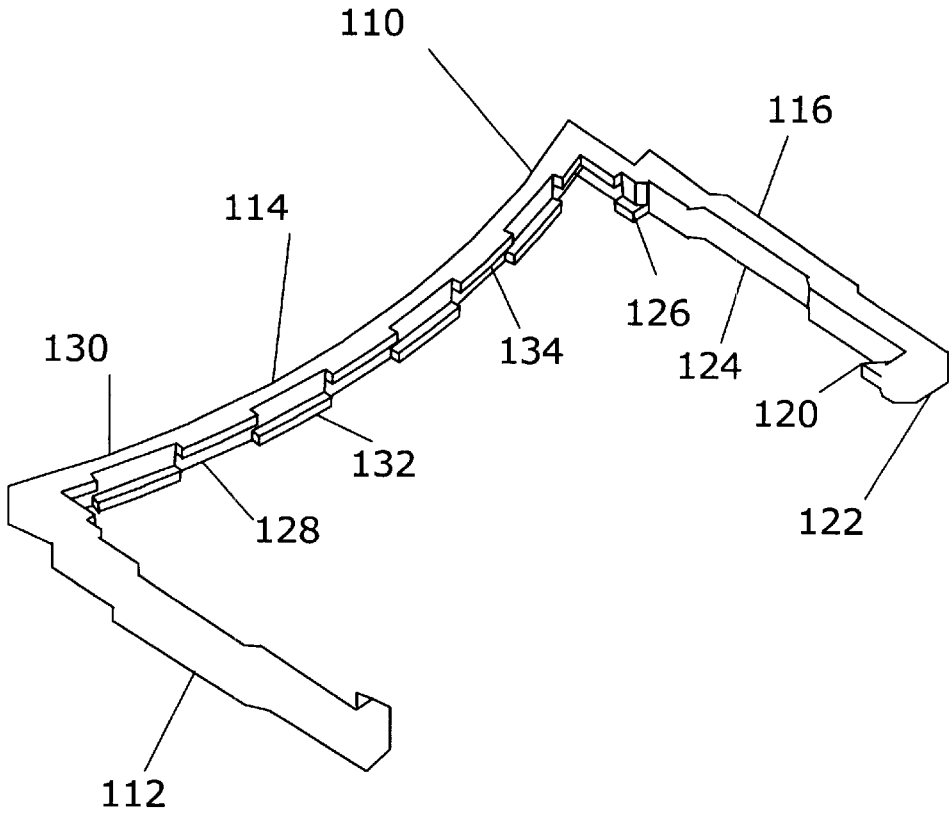
FIG. 2 is an isometric view of a retention bracket/collar in accordance with an embodiment of the invention as shown in FIG. 1.

With reference to FIGS. 1 and 2, there is shown a plan and an isometric view, respectively, of a retention bracket/collar 110 in accordance with an embodiment of the invention. The retention bracket/collar 110 is intended to circumscribe as many dimensions of a circuit card as is necessary to retain the circuit card in its connecting socket under shock/drop conditions, yet not interfere with the electrical or optical connections. As shown in FIGS. 1 and 2, one embodiment of the bracket/collar 110 has three sides 112, 114, and 116 to circumscribe the edges not mating with the connector of a rectangular circuit card (not shown). The opening which is opposite side 114 and between sides 112 and 116 is where either a surface mount type or a pin through hole connector for the circuit card might be positioned on a circuit board. Sides 112 and 116 are mirror images of each other only because the dimensions of the circuit card is symmetric; if the circuit card were not symmetric nor rectangular, it is intended that the shape of retention bracket/collar 110 be modified to correspond to the outer perimeter of the circuit card the bracket/collar 110 is intended to retain.

Sides 112 and 116 may have certain features which will be described with respect to side 112 only. It is understood that if the retention bracket/collar 110 is symmetric, then side 116 will have corresponding features. At the bottom of side 112 is a notch 120 extending away from the bottom edge 122 towards edge 114 of the retention bracket/collar 110. The design of the extending notch 120 is determined by its function and as such, the design may vary and indeed may not even be an extending notch 120. The function of the extending notch 120 is to hook into a corresponding groove in the connector (not shown) to hold the bracket/collar 110 in place with respect to the connector. A portion 124 of the side 112 extends slightly outwards in order to accommodate a side arm spring assembly of the socket (not shown). If the connector does not have a side arm spring assembly, then this portion 124 may be modified. An indentation 126 at an inner corner meets with the corner of the circuit board (not shown).

Side 114 of the retention bracket/collar 110 is concave. An inner edge 128 of side 114 meets with and holds the circuit card (not shown). When the retention bracket/collar 110 is in place, the concavity of the side 114 slightly flattens at the center to provide a spring load against the circuit board pressing into the connector (not shown). There are alternating rectangular grooves 132 and 134 on the inner edge 128, alternating on the top dimension and a bottom dimension of the edge 128 to retain the circuit board. These grooves 132, 134 need not be alternating; rather, a single groove having a width slightly larger than the circuit board, may be machined or otherwise included within the edge 128 to wrap around the edge(s) of the circuit board to hold it securely.

The retention bracket/collar 110 is preferably manufactured using thermoplastic injection molding technology and as such, may be manufactured from polycarbonate. Polycarbonate provides suitable elasticity to deform around the shape of the circuit card and socket while retaining the card firmly in the socket in shock/drop condition. Other materials may be used provided the material does not deform or otherwise crack or break under the stress and temperature environments which may be typical of integrated circuits. It is preferred that the material not be flammable, and in most situations, nonconductive. The bracket/collar 110 may also be manufactured from metal or ULTEM, or other less elastic materials which would provide a larger spring loading force at the inner edge 128 against the circuit card.

Figure 3:
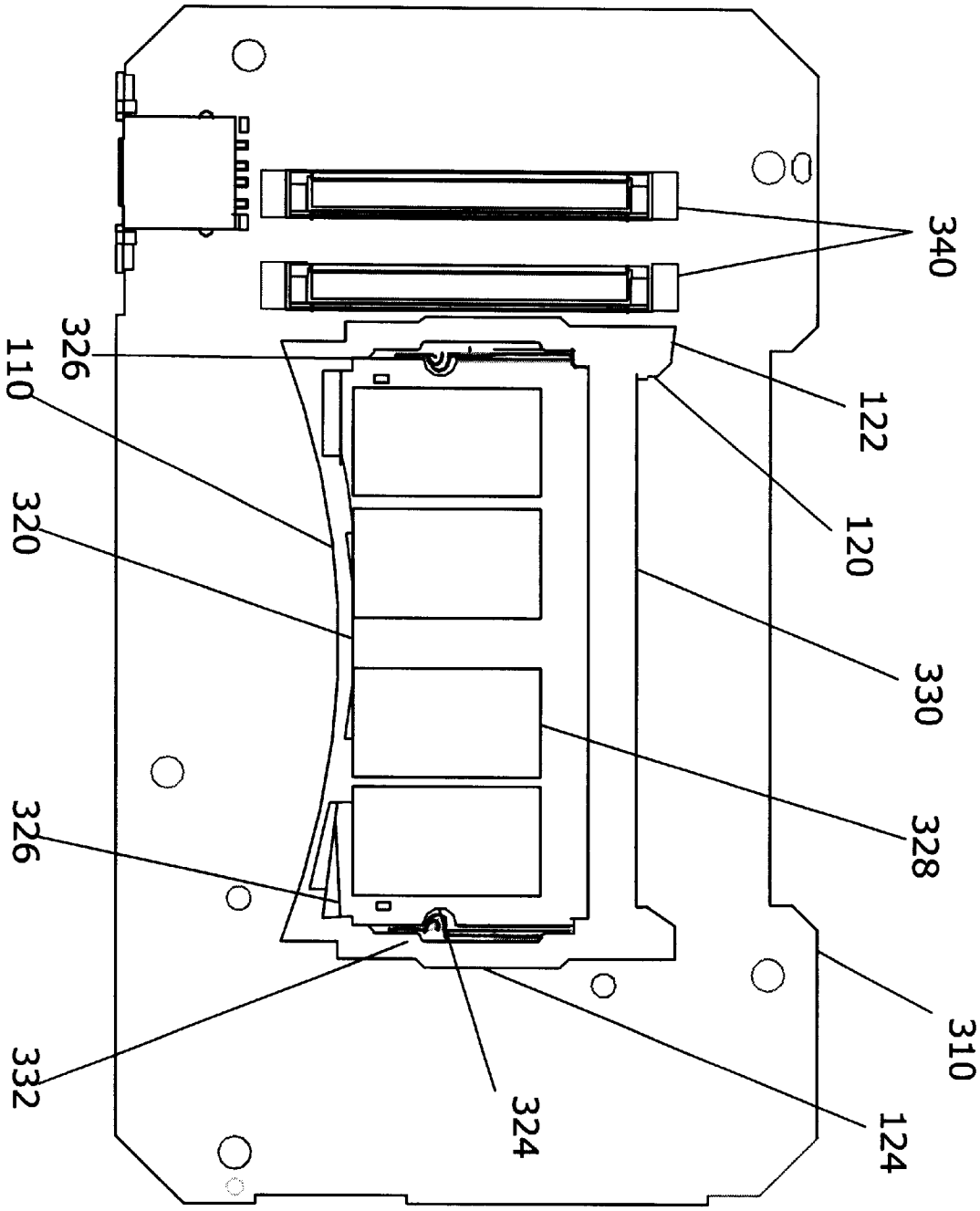
FIG. 3 is a plan view of a circuit card mounted in a socket on a circuit board with the retention bracket/collar in place.
Figure 4:
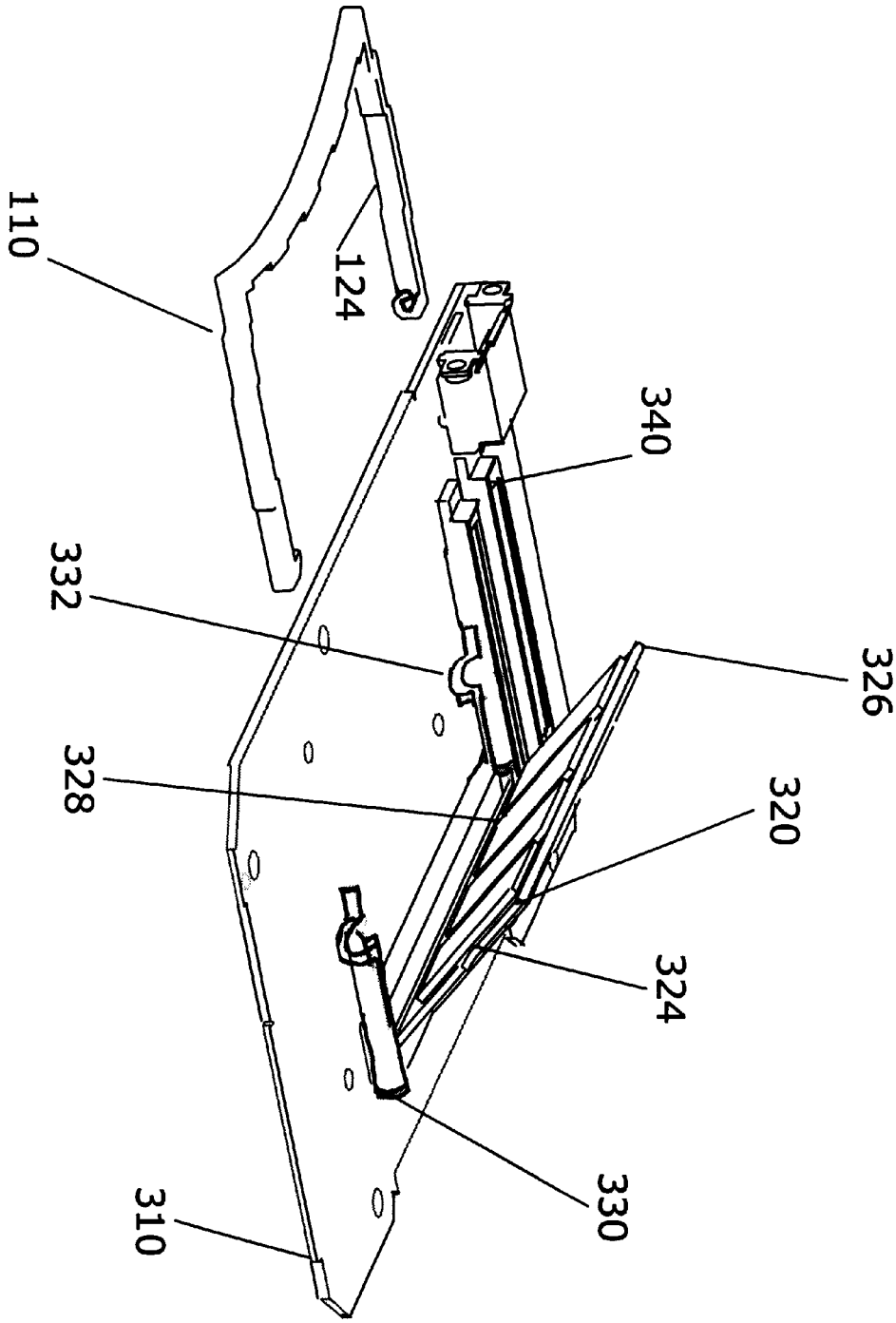
FIG. 4 is an isometric view of a circuit mounted placed at an angle in a socket on a circuit board with the retention bracket/collar shown expanded away from the board.

FIGS. 3 and 4 illustrate the use of the bracket/collar 110 with a circuit card 320 that is to be plugged into a connector 330 on a circuit board 310. Often in the art, the terms "circuit card" and "circuit board" are used interchangeably; in this application, the term "circuit card" will be used to describe an integrated circuit that can be plugged or soldered onto a larger "circuit board". The circuit card 320 shown in FIG. 3 may be a Dual Inline Memory Module (DIMM) have multiple memory chips 328 often used in handheld and other computers. It is further understood that while DIMMs are common, the invention is not limited to DIMM cards plugged into a daughter or mother board and the use of the term DIMM card is shall herein mean other integrated circuit cards as well. This particular DIMM card 320 connects through a surface mount connector (SMT) 330, as is typical of the art. An example of such a connector is the MOLEX S.O. DIMM right angle surface mount technology (SMT) socket. Pin-through-hole connectors may also be used as well as any connector technology which may fail under shock/drop conditions.

As can be seen in FIG. 4, the circuit card 320 is inserted into the connect 330 at an angle with respect to the circuit board 310. Once the electrical connections are made within the connector 330, the card 320 is rotated down towards the board 310, the spring arm assembly 332 of the connector is snapped into the semicircular indentation 324 on either side of the card 320 to hold the card 320 against the board 310. The extending portion 124 of the retention bracket/collar 110 was created to accommodate this spring assembly 332. If, however, other rotation and snap assemblies were to be used, or if none were used, the retention bracket/collar 110 would likewise be modified.

With respect to FIGS. 3 and 4 again, after the card 320 has been inserted into the connector 330 and the card 320 has been rotated to be parallel to the surface of and in electrical or optical contact with the board 310, the bracket/collar 110 is applied by first hooking the notch 120 into a hollow which may be at the corner of the connector 330. Because the bracket/collar 110 is preferably somewhat flexible because of its materials and concave shape, it may be flexed to extend alongside the card 320 and spring assembly 332 near another connector 340, if it exists. The corner indentation 126 of the bracket/collar 110 then fits at the corner 326 of the card 320. The edge of the card 320 opposite the connector 330 is then fit into the molded or machined grooves 132, 134. The inner edge of the bracket/collar 110 is then positioned around the other corner of the card and to the outside of the spring arm assembly 332. The bracket/collar 110 may then be slightly flexed to hook the other bottom notch 124 into the other corner of the connector 330.

It has been determined that when a polycarbonate bracket/collar is placed around a DIMM in this fashion, the handheld computer can be dropped from seven feet and the DIMM will not be displaced from its socket. A significant advantage of the retention bracket/collar herein is that the bracket/collar attaches to the circuit card and connector body without modification to the board layout or the mechanical package design. Thus, the bracket/collar can be added to the design without requiring any other mount points and may be added after market. While the invention has been described in detail herein in accordance with a preferred embodiment thereof, many modifications and changes therein may be realized by those skilled in the art. For instance, if the circuit card is circular or oval, the bracket/collar could be more angular, perhaps a polygon, such as a pentagon, hexagon, dodecagon, to circumscribe the card. If it known that the bracket/collar preloads the DIMM against its connector, if additional loading is desired, either the concavity of the bracket/collar at edge 114 could be increased, or the bracket/collar could be manufactured from a more rigid material. Further, it is intended that the bracket/collar could be used to retain optical cards as well. Accordingly, it is intended by the appended claims to cover all such modifications and changes as fall within the true spirit and scope of the invention.

What is claimed is:

1. A retention bracket/collar for a circuit card comprising:

(a) a semi-rigid collar having at least one outer edge and at least one inner edge, the inner edge having a plurality of grooves alternating on a top and a bottom side to mate with at least one edge of the circuit card; and (b) a shape of the collar and the at least one outer edge being concave to provide a force to the circuit card against the connector.

2. The retention bracket/collar of claim 1, wherein the bracket/collar is manufactured by thermoplastic injection molding.

3. The retention bracket/collar of claim 2, wherein the bracket/collar is made from polycarbonate.

4. The retention bracket/collar of claim 1, wherein the bracket/collar is made from metal.

5. A retention bracket/collar for a circuit card comprising:

(a) a semi-rigid collar having an inner edge with a plurality of grooves alternating on a top and a bottom side to mate with at least one edge of the circuit card;

(b) the semi-rigid collar having a hook to connect to a connector to which the circuit card is connected;

(c) a concave shape on at least one outer edge of the collar opposite one inner edge mating with one edge of the circuit card and opposite the hook to provide a load to the circuit card against the connector; and (d) a corner indentation at the corners of the inner edge to retain a corner of the circuit card.

6. A collar for a circuit card, comprising:

(a) means to circumscribe a plurality of sides not mating with a connector of the circuit card;

(b) means to retain in the collar at least one of the sides of the circuit card not mating with the connector, the retaining means comprising a corner indentation to retain a corner of the circuit cards;

(c) means to apply a spring force to secure the circuit card into the connector; and (d) means to secure the collar to the connector.

7. The collar of claim 6, where the applying means further comprises the concavity of at least one of the plurality of sides of the circuit card not mating with a connector.

8. The collar of claim 6, wherein the securing means is a notched hook on the collar to connect into a hollow in the connector.

* * * * *